United States Patent [19]

Noack et al.

[11] Patent Number: 4,831,220

[45] Date of Patent: May 16, 1989

[54] HIGH-VOLTAGE COMPRESSED-GAS CIRCUIT BREAKER

[75] Inventors: Dieter Noack; Bernd Bruchmann; Michael Punger, all of Berlin, Fed. Rep. of Germany

[73] Assignee: Siemens Aktiengesellschaft, Berlin and Munich, Fed. Rep. of Germany

[21] Appl. No.: 170,277

[22] Filed: Mar. 18, 1988

[30] Foreign Application Priority Data

Mar. 31, 1987 [DE] Fed. Rep. of Germany ..... 8704775

[51] Int. Cl.[4] ..... H01H 33/54

[52] U.S. Cl. ..... 200/148 G; 200/148 E; 200/148 B

[58] Field of Search ..... 200/148 G, 148 E, 148 B

[56] References Cited

U.S. PATENT DOCUMENTS 3,622,725 11/1971 McConnell ..... 200/148 E
3,842,226 10/1974 Yoon ..... 200/148 E
3,846,602 11/1974 Hoffmann ..... 200/148 E
3,943,315 3/1976 Taylor et al. ..... 200/148 E
4,495,435 1/1985 Proud et al. ..... 200/148 G
4,700,029 10/1987 Nicoloso ..... 200/148 G

*Primary Examiner*—Robert S. Macon
*Attorney, Agent, or Firm*—Kenyon & Kenyon

[57] ABSTRACT

A high-voltage compressed-gas circuit breaker having a filter accommodated in a separate housing for the purification of the gas in the gas space of the circuit breaker. For easy accessibility, the housing of the filter is attached at the housing of the corner gear of the operating mechanism. The material of the filter is retained in the filter housing by a perforated metal sheet. In certain embodiments, the filter housing has a rupture plate which is locates below a vertically extending perforated tube that is centrally arranged in the filter housing. Underneath the rupture plate, a housing lid is provided for deflecting possibly escaping switching gases.

9 Claims, 2 Drawing Sheets

HIGH-VOLTAGE COMPRESSED-GAS CIRCUIT BREAKER

This application is related to commonly owned, copending applications Ser. Nos. 170,764 and 170,765, filed on Mar. 21, 1988, each for a "High-Voltage Compressed-Gas Circuit Breaker."

FIELD OF THE INVENTION

The present invention relates to a high-voltage compressed-gas circuit breaker.

DESCRIPTION OF RELATED ART

In known circuit breakers, switch contacts are located in at least one interrupter unit, these contacts being moved by an operating mechanism arranged at ground potential in a frame below an insulating support. This operating mechanism transmits the force required for moving the contacts by means of a corner gear located in the frame at ground potential, and a switching rod of insulating material arranged in the support column. The transmission of force is by intermediate transmissions to the movable switch contacts. A filter accommodated in a separate housing is provided in the gas space of the circuit breaker.

Such a high-voltage compressed-gas circuit breaker is known from "Siemens-Zeitschrift" 1973, page 241 and 1977, page 268. In that known high-voltage compressed-gas circuit breaker, the housing with the filter is closed off by a rupture plate, and is arranged at the outer, especially upper end faces of the interrupter units. The known arrangement has the disadvantage that the housing of the filter is not easily accessible for replacing the material located therein as is required from time to time.

It is an object of the invention to provide a high-voltage compressed-gas circuit breaker with a filter housing that is readily accessible without adversely affecting the filtering action of the materials.

SUMMARY OF THE INVENTION

This and other objects are achieved in the present invention by providing a high-voltage compressed-gas circuit breaker with an insulated support column having a gas space, and an operating mechanism at ground potential arranged inside a frame. The operating mechanism is below the support column and has a corner gear for transmitting the force required for moving switching contacts. A switching rod of insulating material is arranged in the support column, and a filter is located in the gas space. A separate filter housing houses the filter, and is attached to the gear housing.

As stated above, the housing for the filter is attached at the housing of the corner gear. Thus, the filter housing is at ground potential and is very easily accessible in the frame of the circuit breaker located underneath the support column. The replacement of the material after the filter material has become useless presents no difficulties. The filter material becomes useless due to the absorption of decomposition products of the compressed gas, which can occur in connection with switching activities due to arcing or moisture.

An advantageous feature of certain embodiments is a perforated metal sheet in the housing. This sheet retains the material of the filter within the housing without preventing access of the switching gas to the material.

The filter material will not be accidentally displaced when the circuit breaker is transported.

A further advantageous feature of certain embodiments is the combining of the filter housing with a rupture plate, and the provision in the filter housing of a centrally arranged vertical perforated tube. The material of the filter is located between the tube and the lateral walls of the housing while the rupture plate terminates the housing in the region below the tube. In this arrangement, the rupture plate is in direct connection with the gas space of the high-voltage circuit breaker and can therefore respond also directly to pressure increases of excessive magnitude occurring within the circuit breaker.

A still further advantageous feature of certain embodiments is the mounting of the circuit breaker on legs, to allow a housing lid to be arranged below the rupture plate. This housing lid covers the space underneath the rupture plate and has at least one upwardly-directed opening at the circumference of the housing. The housing lid ensures that the hot gases ejected into the environment from the gas space of the high-voltage compressed-gas circuit breaker, if the rupture plate is destroyed, are deflected upwardly, so that persons who happen to be underneath the circuit breaker will not be exposed to the gases.

DETAILED DESCRIPTION

Figure 1:
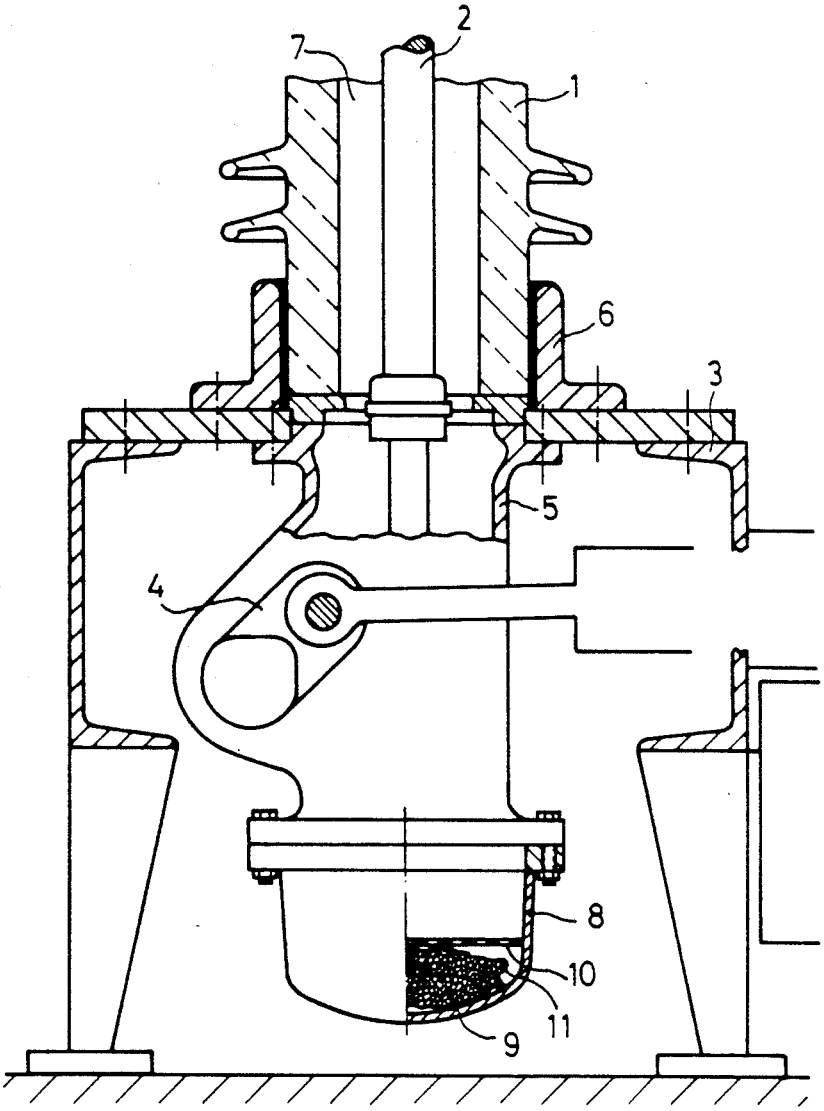
FIG. 1 shows a partial section through a frame of an high-voltage compressed-gas circuit breaker constructed in accordance with the present invention.

In the high-voltage compressed-gas circuit breaker illustrated in FIG. 1, a switching rod 2 of insulating material is arranged within a support column 1. The switching rod 2 actuates switch contacts located in the interrupter units, not shown, which takes place by respective intermediate transmissions. The switching rod 2 bridges the space between the interrupter units with the intermediate transmission, not shown, which carries high-voltage potential and the frame 3 of the circuit breaker which is at ground potential. This frame 3 also carries the operating mechanism, not shown, and control means with the hydraulic accumulators.

The forces required for switching are transmitted to the switching rod 2 by a corner gear 4 driven by the operating mechanism, not shown. The housing 5 of the corner gear 4 is connected directly to the lower flange 6 of the support column 1. A gas space 7 which is located within the support column 2 is filled with $SF_6$, and is also connected to the interior of the housing 5.

A housing 8 for the filter 9 is fastened underneath the housing 5 of the corner gear 4. The filter housing 8 contains a perforated metal plate 10, below which is located the material of the filter 9 which is arranged in small bags 11. The filter 9 is protected by the perforated metal sheet 10 against undesired displacements if the circuit breaker is transported in a non-vertical orientation for installation purposes.

Figure 2:
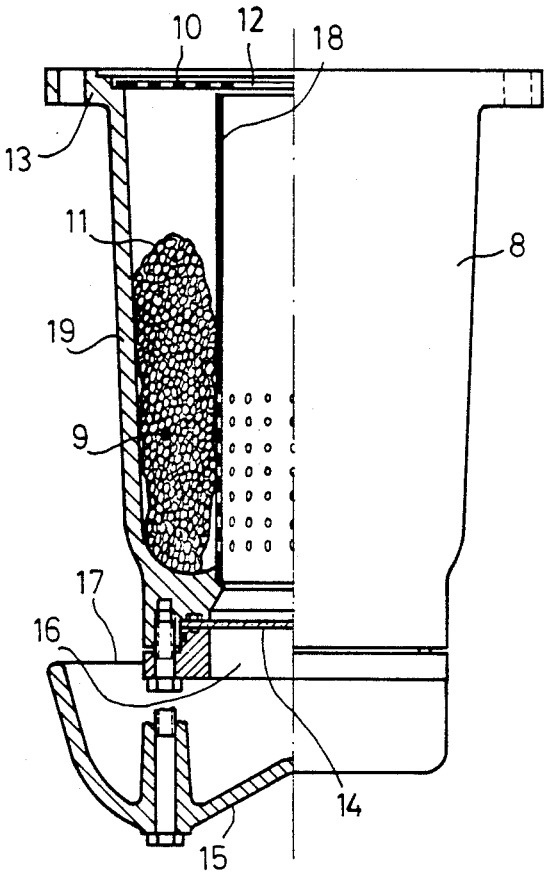
FIG. 2 shows another embodiment of a filter housing in accordance with the present invention.

The securing of the perforated sheet 10 within the filter housing 8 is simplified in the embodiment of the filter housing 8 shown in FIG. 2 where the same referance numbers have been retained for the same elements. As can be seen, the perforated sheet 10 is arranged at the flange 13 of the filter housing 8.

In the embodiment of FIG. 2, the filter housing 8 is closed off by the rupture plate 14. In case of an accident, the rupture plate 14 protects the walls of the gas space of the high-voltage compressed-gas circuit breaker against excessive pressure increases, these walls being formed substantially of porcelain. At a pre-set internal pressure, the rupture plate 14 is destroyed and the pressurized gases of the circuit breaker are conducted into the environment. In order to deflect these gases, a housing lid 15 is arranged below the rupture plate 14. The housing lid 15 covers an opening 16 in the filter housing 8 below the rupture plate 14 and has only one upwardly-directed opening 17 at the circumference of the filter housing 8. The hot switching gases leaving through the rupture plate 14 are thereby conducted off upwards harmlessly, so as to prevent an exposure of personnel to the switching gases.

In order to keep the space above the rupture plate 14 free for access of the switching gases, a vertically extending perforated tube 18 is provided centrally in the filter housing 8. The small bags 11 containing the filter material are located between the tube 18 and the lateral walls 19 of the housing 8. The interior of the filter housing 8 is further closed off by the perforated sheet 10 arranged within the area of the flange 13 of the filter housing 8. The perforated sheet 10 has a larger central opening 12 and also fixes the tube 18 within the filter housing 8. As in the embodiment of FIG. 1, the high-voltage compressed-gas circuit breaker using the filter housing 8 of FIG. 2 can be transported in different positions.

What is claimed is:

1. A high-voltage compressed-gas circuit breaker, comprising:

an insulated support column having a gas space;

an operating mechanism at ground potential arranged inside a frame, said operating mechanism being below said support column and having a corner gear inside a housing for transmitting force required for moving switching contacts;

a switching rod of insulating material arranged in said support column;

a filter in said gas space; and a separate filter housing for housing said filter, said filter housing being attached to said gear housing.

2. A high-voltage compressed-gas circuit breaker according to claim 1, further comprising a perforated metal sheet in said filter housing for retaining said filter material within said separate housing.

3. A high-voltage compressed-gas circuit breaker according to claim 2, wherein said separate housing has a flange and said perforated metal sheet is arranged at said flange.

4. A high-voltage compressed-gas circuit breaker according to claim 2, further comprising:

a vertically extending perforated tube centrally arranged in said filter housing of filter;

a rupture plate for closing off said filter housing, and for terminating said filter housing below said tube;

wherein material of said filter is arranged between said tube and lateral walls of said housing.

5. A high-voltage compressed-gas circuit breaker according to claim 4, further comprising:

a housing lid underneath said rupture plate for covering an opening in said housing underneath said rupture plate, said lid having at least one opening directed upwardly at a circumference of said housing.

6. A high-voltage compressed-gas circuit breaker according to claim 4, wherein openings of said perforated tube are located in a lower area of said tube which is adjacent to said rupture plate.

7. A high-voltage compressed-gas circuit breaker according to claim 1, further comprising:

a vertically extending perforated tube centrally arranged in said filter housing of the filter;

a rupture plate for closing off said filter housing, and for terminating said filter housing below said tube;

wherein material of said filter is arranged between said tube and lateral walls of said housing.

8. A high-voltage compressed-gas circuit breaker according to claim 6, further comprising:

a housing lid underneath said rupture plate for covering an opening in said housing underneath said rupture plate, said lid having at least one opening directed upwardly at a circumference of said housing.

9. A high-voltage compressed-gas circuit breaker according to claim 6, wherein openings of said perforated tube are located in a lower area of said tube which is adjacent to said rupture plate.

* * * * *